166-308 SR
1/12/88 OR 4,718,493

United States Patent [19]
Hill et al.

[11] Patent Number: 4,718,493
[45] **Date of Patent: * Jan. 12, 1988**

[54] WELL TREATING METHOD AND SYSTEM FOR STIMULATING RECOVERY OF FLUIDS

[75] Inventors: Gilman A. Hill, Englewood; Richard S. Passamaneck, Littleton; Kenell J. Touryan, Indian Hills, all of Colo.

[73] Assignee: Mt. Moriah Trust, Englewood, Colo.

[ * ] Notice: The portion of the term of this patent subsequent to Jan. 6, 2004 has been disclaimed.

[21] Appl. No.: 943,551

[22] Filed: Dec. 18, 1986

Related U.S. Application Data

[63] Continuation-in-part of Ser. No. 686,990, Dec. 27, 1984, Pat. No. 4,633,951.

[51] Int. Cl.[4] ..... E21B 43/26; E21B 43/267
[52] U.S. Cl. ..... 166/308; 166/63; 166/297; 166/385
[58] Field of Search ..... 166/297, 298, 299, 308, 166/309, 280, 55, 55.1, 63; 175/4.6

[56] References Cited

U.S. PATENT DOCUMENTS

| | | | |
|---|---|---|---|
| 2,766,828 | 10/1956 | Rachford, Jr. | 166/308 |
| 3,101,115 | 8/1963 | Rirodan, Jr. | 166/300 |
| 3,136,361 | 6/1964 | Marx | 166/308 |
| 3,170,517 | 2/1965 | Graham et al. | 166/308 X |
| 3,303,880 | 2/1967 | Scott | 166/63 X |
| 3,744,579 | 7/1973 | Godfrey | 175/67 |
| 3,937,283 | 2/1973 | Blauer et al. | 166/307 |
| 4,039,030 | 8/1977 | Godfrey et al. | 166/299 |
| 4,391,337 | 7/1983 | Ford et al. | 175/4.6 |
| 4,633,951 | 1/1987 | Hill et al. | 166/308 |

*Primary Examiner*—Stephen J. Novosad
*Attorney, Agent, or Firm*—Hubbard, Thurman, Turner & Tucker

[57] ABSTRACT

Subterranean oil and gas producing formations are fractured by filling a well casing with a compressible hydraulic fracturing fluid comprising a mixture of liquid, compressed gas, and propant material and precompressed to a pressure of about 1,000 psi or more greater than the fracture extension pressure at the depth of the zone to be fractured. A perforator is provided in the casing to form fluid exit perforations at the selected depth of the fracture zone. Following perforation the perforated zone is fractured by the precompressed fracturing fluid laden with propant material that is discharged into the formation until the hydraulic extension pressure is reached and the perforations are eventually sanded off. Optionally, filling of the well bore is maintained continuously through the filling and perforation of the casing until after decompression of the fracturing fluid is completed.

9 Claims, 10 Drawing Figures

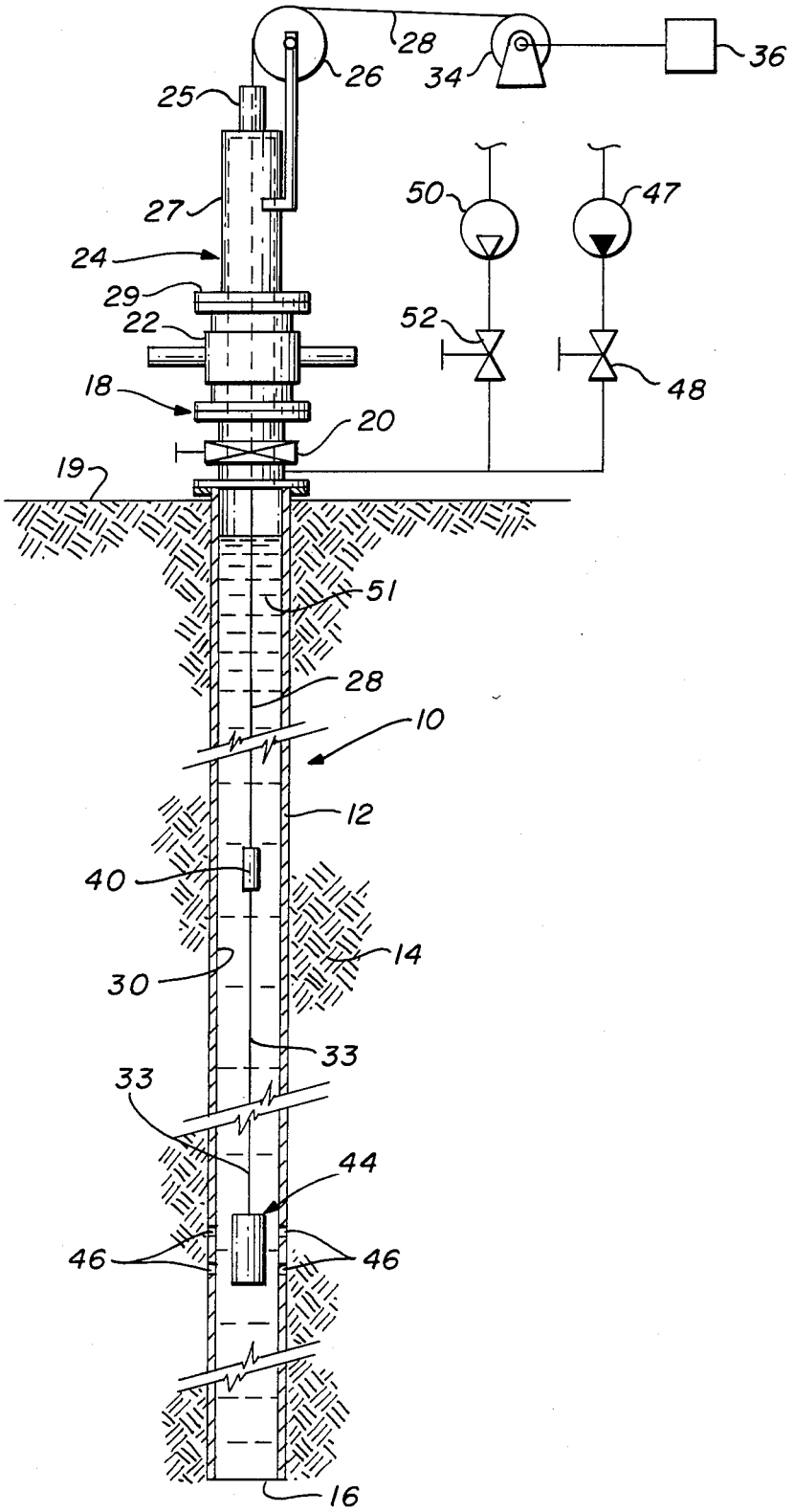
28
26
34
36
25
27
50
47
24
29
22
52
48
18
20
19
51
28
10
12
40
14
30
33
33
44
46
46
16

WELL TREATING METHOD AND SYSTEM FOR STIMULATING RECOVERY OF FLUIDS

This application is a continuation-in-part of application Ser. No. 686,990 filed Dec. 27, 1984, now U.S. Pat. No. 4,633,951.

TECHNICAL FIELD

The present invention pertains to a method and system for fracturing a subterranean rock formation to stimulate the recovery of oil, gas and other fluids by producing fractures in the formation from the decompression release of a highly compressed propant laden, compressible fracturing fluid.

BACKGROUND OF THE INVENTION

In the art of treating subterranean formations to stimulate the recovery of fluids such as crude oil and gas, hydraulic fracturing of one or more fluid rich zones is widely practiced. Conventional hydraulic fracturing techniques suffer from several disadvantages, depending on the characteristics of the rock formation. In almost all cases the development of the fracture and the ultimate yield of fluids from the formation as a result of the fracture is limited by the inability to pump fluids down the wellbore and out through perforations in the well casing at a rate sufficient to overcome pipe friction losses and leak off of the fracturing fluid into the formation itself. Typically, the fracturing fluid pumping rate in many applications may not be sufficient to initiate and maintain a fracture for an adequate duration of time to accept a sufficient amount of propant carried in the fracturing fluid to open the fractures wide enough so as to produce satisfactory yields of well fluids.

In order to overcome the disadvantages and limitations of conventional surface pumping of subterranean formation fracturing fluids it has been proposed to place devices in the wellbore at various depths which will generate sufficient energy to propel a quantity of fracturing fluid into the formation. For example, U.S. Pat. No. 3,101,115 to M. B. Riordan, Jr. describes a well treating method and apparatus wherein a gas generator canister is lowered into a wellbore above a column of fluid in the wellbore and ignited to generate gases for propelling the liquid fracturing fluid into the formation to be fractured without interrupting the continuous delivery of fluid to the wellbore by surface pumps. However, the system and method contemplated by the Riordan, Jr. patent utilizes the gas generator only to boost the flow rate of conventional liquid well treating fluids momentarily and does not develop a preliminary "pad" of gas as part of the initial fracturing process and flowing ahead of a propant laden well treating fluid.

U.S. Pat. No. 4,039,030 to Godfrey et al contemplates the use of an explosive charge and a propellant generator in a wellbore wherein the propellant is detonated first followed by the detonation of a high explosive to maintain pressure of the high explosive over a longer period of time to extend the fractures caused by the explosive while pumping a fracturing fluid into the fractured formation.

An improvement in gas generating and injection devices for perforating a well casing at a production zone and initiating fractures with the production of a propellant gas is disclosed and claimed in U.S. Pat. No. 4,391,337 issued jointly to Franklin C. Ford, Gilman A. Hill and Coye T. Vincent. In this patent a combustion gas generator is provided in the form of a canister which may be suspended in the wellbore and is provided with a plurality of spaced apart shaped charge devices or grenades for perforating the well casing and contiguous layer of cement, if used, to provide apertures for the flow of gas and other fluids to be injected into a formation to be produced.

Accordingly, the prior art suggests the provision of downhole gas generators for use in fracturing operations which have not proven particularly attractive from an economic or technical viewpoint. In conventional hydraulic fracturing, even with the use of downhole propellant gas generators, a substantial amount of hydraulic power capability must be maintained at the surface in the form of large pumping capacity. The energy losses suffered in transmitting the hydraulic fluid through the well pipe or casing cannot be sufficiently overcome to provide the substantial volumes of fluid at pressures required to perform a suitable high stress fracture. Moreover, such prior art methods have not provided for an economical process able to generate suitable fracture initiation and entry into the fractures of a fluid that will satisfactorily open the fractures ahead of the entry of a propant laden fracturing fluid without involving the use of gas generators.

SUMMARY OF THE INVENTION

The present invention provides a method for treating a subterranean formation to stimulate the production of fluids, such as liquid and gaseous hydrocarbons, by providing a relatively high stress fracture of the formation. The fracture is propagated in several planes in a production zone while dissipating a propant laden fluid into the fractures for maintaining the fractures open to enhance the flow of fluids into a wellbore from which the fracture was initiated.

In accordance with an important aspect of the present invention the fracturing method includes a high level of precompression of a column of a compressible fracturing fluid in the wellbore and wherein the compressed fluid is released to flow through perforations in a well casing initiated by a device comprising shaped casing perforating projectiles or charges. In a preferred embodiment the method contemplates the compression of a slurry or foam type fluid made up of a liquid having dispersed throughout a compressible gas and a solid propant such as granules of sand, glass, bauxite, etc., which fluid is precompressed over a period of time to a pressure of 1,000 psi or more in excess of the normal hydraulic fracture extension pressure of the zone to be fractured. Following perforation of the casing by perforating guns at the selected depth the energy stored in the compressible fluid is released through the perforations in a rapid decompression process to produce a very high velocity outflow of fracturing fluid that deposits a compressed gas "pad" in the formation fractures.

In accordance with another important aspect of the present invention, surface generating equipment of the fracturing fluid may be continuously operated throughout the precompression of the fracturing fluid, the perforation step and the decompression cycle to increase the fracture distance in which the fracture fluid can be effective. Such continuous operation contemplates the equipment providing a continuing injection into the well bore of the fracturing fluid until the fluid leak-off causes a sand-off bridging in the fracture.

In accordance with a still further important aspect of the present invention the fluid well bore pressure is gradually restored after sand-off has occurred to build a sand-pack bridge back from the fracture, through the perforations to within the well bore casing to cover all perforations in the casing wall. Once the prior perforations are completely sealed, the prior cycle can be repeated for a subsequent zone to be stimulated.

The system and method of the present invention provides for producing fractured subterranean formations for stimulating the production of oil and gas, in particular, although those skilled in the art will recognize that other purposes may be served by the formation fracturing or well treating system and method of the present invention. Those skilled in the art will also recognize that the method utilizes essentially conventional well equipment which does not require any substantial modification and that wells which have been previously stimulated may be reworked using the fracturing fluid decompressing method of the invention. Those skilled in the art will recognize advantages and superior features of the invention other than those described hereinabove upon reading the detailed description which follows in conjunction with the drawing.

BRIEF DESCRIPTION OF THE DRAWING

FIG. 1 is an elevation in somewhat schematic form of a wellbore and subterranean formation with the fracturing system of the present invention in position to be actuated to provide a fracturing operation.

DESCRIPTION OF THE PREFERRED EMBODIMENTS

In the description which follows like components are marked throughout the specification and drawing with the same reference numerals, respectively. The drawing FIGURE is not necessarily to scale and certain features may be shown exaggerated in scale or in somewhat schematic form in the interest of clarity and conciseness.

The method and system of the present invention are particularly adapted for the use in fracturing subterranean formations under a variety of geological conditions but, in particular, for fracturing relatively low permeability, tight sand, gas and liquid hydrocarbon reservoirs. Referring to FIG. 1, for example, there is illustrated a well, generally designated by the numeral 10, formed by an elongated cylindrical casing 12 of conventional construction and extending into a rock or tight sand subterranean formation 14. The depth of the well 10 may range from several hundred to several thousand feet and it is contemplated that the method and system of the invention may be used in conjunction with a wide variety of wells over a substantial range of well depths wherein, for example, a substantial number of different production zones may be stimulated in accordance with the invention. The casing 12 will be described further herein as conventional steel well casing although other materials can be used.

The casing 12 extends to a bottom plug 16 at the maximum depth of the well 10 and the casing extends to a conventional wellhead 18 at the surface 19. Although a specific example of carrying out the method of the present invention will be described herein, the wellhead components for the well 10 may be selected from a variety of commercially available equipment. Typically, the wellhead 18 includes a valve 20 above which a blowout preventer 22 is mounted. A conventional wireline lubricator assembly 24 is mounted on the wellhead 18 above the blowout preventer 22 and includes a stuffing box 25 and a top block 26 for reaving a conventional wireline 28 thereover and down through the stuffing box, lubricator 24, blowout preventer 22 and the valve 20 into the interior space 30, comprising the wellbore. The lubricator 24 preferably includes a hollow riser section 27 and suitable coupling means 29 for connecting and disconnecting the lubricator with respect to the wellhead 18. The wireline 28 is typically trained over a drum type hoist 34 for paying out and reeling in the wireline. A suitable control console 36 is connected to the wireline 28 via the hoist 34 for receiving and transmitting signals through the wireline 28 for the operations to be described herein.

As shown in FIG. 1, the wireline 28 extends downward to an instrument unit 40 having suitable depth measuring and pressure measuring instruments adapted to transmit depth and pressure readings to the controller 36. A second section of wireline 33 extends downward to a suitable perforating gun 44 for perforating the casing 12 to provide a plurality of perforations or apertures 46. The wellbore 30 is also operable to be in communication with a source of a compressible fracturing fluid by way of a pump 47 and a control valve 48. A source of compressed gas, not shown, may be placed in communication with the wellbore 30 by way of a gas pump 50 and a suitable shutoff or control valve 52.

Generally speaking, the present invention contemplates the provision of the perforating unit 44 at a selected depth in the wellbore 30, and wherein the wellbore is filled with a quantity of compressible fracturing fluid 51 preferably comprising a slurry or foam made up of a suitable liquid such as water in which a relatively high concentration of abrasive propant such as sand, glass, mica, or bauxite is dispersed in suspension. The fracturing fluid is also injected with compressed gas to provide a foam quality or gas content by volume to about 80 percent of the total volume of the fracturing fluid thereby allowing effective transportation of the solid propant and suitable compression of the fluid as will be described herein. Those skilled in the art will recognize that other compressible, propant carrying fluid compositions may be utilized in practicing the present invention.

For performing fractures at formation depths in the range of 5,000 feet to 10,000 feet and wellbore pressures, prior to performing a fracturing operation of from 9,000 psi to 13,000 psi, a foam quality of about 62 percent to 70 percent is preferable with a sand propant concentration of typically about 3.0 lbs. to 7.5 lbs. of sand per gallon of foam and providing a total density of fluid 51 of about 5.7 lbs. to 11.0 lbs. per gallon. The wellbore 30 is at least partially and preferably completely filled with the compressible fracturing fluid 51 having the abovementioned physical properties and, over an extended period of time, the pressure in the wellbore is increased by pumping fluid into the wellbore to about 1,000 psi or more in excess of the normal pressure required to extend a fracture at the depth of the formation to be perforated. The pressure required to extend a fracture is determined to be that which exceeds the least principal stress in the formation at the depth of the zone to be fractured which may be assumed to be approximately 0.77 psi per foot of depth.

Upon increasing the fracturing fluid pressure to the abovementioned value, the casing 12 is then perforated to form the apertures 46 to release the potential energy stored in the compressed fracturing fluid. A rapid decompression process occurs to produce a very high velocity outward expansion and outflow of the propant laden fracturing fluid 51 into the network of rapidly expanding high stress fractures initiated in the formation. By compressing the volume of fracturing fluid in the wellbore, followed by the release of the compressed fluid, an effective hydraulic horsepower delivery is experienced as decompression occurs.

After perforation of the well casing, the expanding fracturing fluid will flow through the casing apertures 46, for example, at sonic velocity as a limiting velocity and will cut extensive channels or slots into the formation. Beyond the channels formed by fluid erosion the pressure of the fluids flowing outwardly will create one or more high stress fractures in the formation resulting in the initiation or extension of a multiplicity of fractures and wherein the expanding fracturing fluid will carry the propant material into the fractures to hold them open. After the initial pressure of the expanding fluid subsides, the normal hydraulic fractures along the planes in the formation perpendicular to the least principal stress in the region will continue to propagate outward from the immediate vicinity of the wellbore.

The decompression process of the fracturing fluid may last anywhere from three seconds to ten seconds depending on the volume of fluid in the wellbore, the perforation aperture flow area and the physical characteristics of the formation. As the flow rate into the fracture zone decreases and the leak off of fluid into the formation becomes larger than the inflow rate of fluid, the fracture widths will decrease until the sand propant bridges and plugs the fracture resulting in a termination of fracture injection or sandoff. Once sanding off has occurred, a continuing slow leakage of the fracturing fluid out into the fracture zone will occur while propant material strains out and fills the erosion channels behind each casing aperture or perforation and then fills the perforation holes themselves. A sand cake or pod will build over each perforation effectively sealing the apertures against any further breakdown and passage of fluid into the zone during subsequent fracturing operations on other zones.

Shaped charges provided by perforator 44 are interconnected by a fast burning fuse such as a Primacord type fuse or other suitable ignition signal carrier which is ignited by an electrical signal transmitted via wire line 28. The shaped charge inserts may be surrounded with a fast burn pyrotechnic material in the receiving holes to provide ignition communication between a fast burn outer ring 72 and the charge itself. In accordance with the overall method contemplated by the present invention, the cumulative cross sectional area of the apertures 46 formed in the well casing 12 created by the perforating charges should be equal to or smaller than the cross sectional area of the casing inside diameter. For example, for a nominal 5.5 inch outside diameter well casing and with 28 perforating charges spaced over a 7.0 ft. length of the perforator 44 the charges should be designed to provide perforation diameters of about 0.88 to 0.9 inches. The depth of penetration of the charges does not need to be more than about 3 to 4 inches since penetration of the casing 12 and any annular cement sheath disposed therearound is all that is required for the perforation process.

The characteristics and procedure for fracturing a formation in a well 10 provided with a well casing 12 as illustrated in FIG. 1, will now be described. By way of example, it will assumed that the well depth provided by the casing 12 is about 12,000 feet and that a fracture is to be performed by perforating the casing 12 at a depth of 10,000 feet using a fracturing fluid having a foam quality of about 62 to 70 percent and made up basically of water with conventional fracturing fluid additives, nitrogen gas and a sand suspension preferably in the range of about 3.0 pounds to 7.5 pounds of sand per gallon of foam to provide a total foam fluid weight of about 5.7 pounds to 11.0 pounds per gallon.

Prior to the initial perforating and fracturing process, the perforation unit 44 is inserted in the wellbore 30 through the lubricator 24 suitably connected to the wireline 28. The wellbore 30 is then filled with fracturing fluid 51 of the above mentioned characteristics which, for a 5.5 inch diameter steel casing having a wall thickness to provide a casing weight of about 20 pounds per foot, will hold about 1425 cubic feet of fluid. Fracturing fluid 51 is injected into the casing 12 via pump 47 until, for example, wellbore pressure at the surface is increased to about 8,500 psig. The total aperture flow area for the apertures 46 are assumed equal to the cross sectional flow area of the wellbore 30 to match the foam fluid decompression flow from above and below the apertures. If the perforation apertures are made at or near the bottom of the well casing 12 or the bottom of the effective depth of the wellbore 30 the cross sectional flow area may be made approximately equal to the casing or well bore cross sectional flow area.

A typical pump-in volume required to recharge a 5.5 inch diameter casing of 10,000 ft. depth between each fracturing operation is estimated to be approximately 80,000 standard cubic ft. of nitrogen gas to produce 66 percent quality foam at 8,500 psi and 140° Fahrenheit, 20.8 barrels of water and additives and 18.9 barrels of fracture propant sand (17,750 pounds) for a total of approximately 80 barrels of fluid. Using a maximum sand concentration of about 20 pounds of sand per gallon of water slurry during pump-in, the pumping rate is about 4 barrels per minute thereby requiring about 10 minutes to pump approximately 40 barrels of the water-sand slurry. Wellbore recharge is completed when the surface wellhead pressure reaches about 2,000 psi below the API rated casing internal yield pressure. At this time, the system is then fully recharged and is ready for another decompression fracturing and stimulating operation.

When desired well bore surface pressure of 9,000 psig is reached, the downhole-positioned guns of perforator 44 are electrically fired to create the selected flow areas of apertures 46 through the casing and into the formation and which for example could be about 26 square inches in a 5.5 inch diameter casing. The freshly cut casing perforation apertures 46 release the highly compressed fracturing fluid 51 to flow out into the formation fractures at very high volume rates and very high velocities. With 14,000 psig inside the casing at a 10,000 foot depth, and with 22 square inches of aperture hole area, the initial volume rate of fluid flow into the apertures with a fluid flow coefficient of 0.2 can be about 5,000 cfm or 900 bbls/min. At the fracture extension pressure, the volume flow rate can increase to about 8600 cfm or 1550 bbls/min.

Within about 3.7 seconds for a 10,000 ft. well, the decompression wave of fluid 51 will arrive at the casing surface, resulting in a decompression/expansion of the fluid emplacing about 174 cu. ft. of fluid with about 7,815 pounds of fracture sand into the formation fractures. At the fracture extension pressure of about 8200 psi @10,000 ft., the injected fluid will expand to about 262 cu. ft., thereby creating about 262 cu. ft. of fluid in less than about four seconds with an average volume rate in the fracture of about 4,000+ cfm or 700 bbls/min.

Decompression of the fluid 51 will continue at decreasing volume rates to asymptotically approach zero as the well bore pressure approaches equilibrium with the formation fracture extension pressure. However, as the volume rate of flow into the fracture decreases to a low value, the fracture leak-off will cause a sand-off bridge to develop, thereby stopping fluid flow when the average fluid pressure in the well bore is still above a value in equilibrium with the formation fracture extension pressure. The resulting total sand and foam injected by the fluid into the formation fractures will typically be about 14,000 lbs. of sand and about 470 cu. ft. of fluid at the fracture extension pressure at 10,000 ft.

Where is is desired to extend the fluid fracture for a greater distance outward from the casing the surface generating equipment previously utilized for filling and precompression of fluid 51 in well bore 30, i.e., sand blender, pump, and nitrogen source, may be operated continuously throughout the well bore compression cycle, the firing of the perforating guns, and the decompression cycle. This continuing operation of the surface generating equipment can thereby provide a continuing injection in the well bore of about 10 to 30 bbls/min (or more, if desired) of sand-laden fluid 51 to extend the formation hydraulic fracture until fluid leak-off causes a sand-off bridging in the fracture. In this arrangement the fluid injection rate into the formation fracture will decline to asymptotically approach the rate that the surface generating equipment is injecting fluid into the well bore. The formation fractures may, thereby, be substantially extended until the rate of fracture fluid leak-off into the formation and sand fall-out causes a sand-off bridging in the fracture to halt fluid flow therein. To continue to propagate this hydraulic fracture for a substantial distance, the injection rated at the surface may, typically, be about 15 to 20 bbl/min or higher. To stop the fracture propagation and to optimally pack the fracture with sane, the surface injection rate is slowly decreased until sand-off in the fracture occurs.

After the fracture packing sand-off has occurred, the well bore pressure can optimally be slowly raised to gradually build the sand pack bridge back from the fracture, through the perforations, and into the well bore inside the casing until all of the perforation holes in the casing wall are covered. The elevated well bore pressure will cause the foam to slowly flow out through this sand pack and bleed off into the formation. This can serve to filter out the fracture sand, and thereby continue to build the bridging sand pack covering each perforation hole, and possibly filling the casing volume around the perforation hole. Bridging of the sand pack volume will continue to build until this fluid foam leak-off through the perforations becomes negligibly small. When the latter occurs, the prior perforations become adequately sealed off enabling the well bore casing above the sealed area to be pressured up for precompressing a fresh supply of fluid 51 for repeating the foregoing operational cycle at a subsequent zone location selected for stimulation. During the foregoing, wireline 28 can be withdrawn from the well bore, a new set of perforating guns for perforator 44 can be placed in the hole, and the fracturing fluid pressured up as before. The electric wireline 28 may be run in the hole at rates of about 200 ft/minute and may be pulled out of the hole at rates of about 400 ft/minute. The total time between successive stimulation treatments of separate, selected zones at about 10,000 ft. depth in the manner described can range from about 1½ hours to 2½ hours.

It will be appreciated in connection with the fracture development just described that a majority of foam decompression could occur in a direction substantially perpendicular to the least principal stress of the rock formation, i.e., parallel to the natural fractures and the normal hydraulic fracture pattern. The very high injection rates occurring in the first few seconds of stimulation may create intense local rock stresses, thereby producing multi-directional stress fractures in the stimulated formation. In particular, the rock stress created by the rapid opening of the primary hydraulic fracture may increase the local stress in the direction of the pre-existing least-principal stress to values which exceed the rock stress perpendicular to that direction, resulting in the initiation of secondary fractures in the direction perpendicular to the normal primary hydraulic fracture. This secondary perpendicular fracture can have unique value, especially in stimulating naturally fractured formations which have very small matrix permeability.

The foregoing detailed description of a fluid decompression type formation fracturing operation is intended to be primarily exemplary only. The process may be carried out in wells drilled offshore as well as onshore. The actual volumes of material and times required will vary somewhat with the diameter of the well casing, the overall depth of the well and the location of the zone being fractured.

Those skilled in the art will also recognize various other substitutions and modifications with respect to the system and process described herein and which may be employed without departing from the scope and spirit of the invention recited in the appended claims.

We claim:

1. A method for fracturing a subterranean earth formation to stimulate the production of fluid from said formation wherein a wellbore extends at least to said formation from a surface point, said wellbore being provided with casing means forming a substantially fluid tight interior space, said method comprising the steps of:

providing perforating means for perforating said casing means at a predetermined zone of said formation to provide for flow of fluids between said formation and said wellbore and placing said perforating means at said zone, filling at least a portion of said wellbore with a compressible fracturing fluid comprised of a liquid containing dispersed quantities of gas and having a solid propant dispersed therein;

raising the pressure of said fracturing fluid in said wellbore to a predetermined pressure greater than the pressure required to hydraulically extend a fracture in said formation at said zone; and actuating said perforating means to form apertures in said casing means whereby the pressurized fracturing fluid at said predetermined pressure is allowed to flow into said formation under decompression forces to fracture said formation with a quantity of said fracturing fluid and to prop fractures in said formation open with said propant.

2. The method set forth in claim 1 wherein:

said apertures are formed to have a cumulative flow area correlated to the cross sectional flow area of said casing means at said apertures.

3. The method set forth in claim 1 wherein:

said perforating means is disposed at a position in said casing means above the bottom of said wellbore to provide for flow of fracturing fluid through said apertures in substantial quantity from above and below said apertures on decompression of the fracturing fluid in said wellbore by perforating said casing means.

4. The method set forth in claim 1 wherein:

the pressure of the fracturing fluid is raised to a value of about 1,000 psi or more greater than the fracture extension pressure at said zone.

5. The method set forth in claim 4 wherein:

said fracturing fluid is provided with propant sand in a concentration of about 3.0 lbs./gallon to 7.5 lbs./gallon of fracturing fluid.

6. The method set forth in claim 1 wherein:

at least said step of filling said well bore is continued during and after the step of actuating said perforating means and while said fracturing fluid is allowed to flow into said formation under decompression forces.

7. The method set forth in claim 1 wherein:

there is included the added step of gradually rebuilding the well bore pressure after packing sand-off has occurred in the fracture, to build a sand pack bridge back from the fracture, through said apertures to the interior of said casing.

8. The method set forth in claim 7 wherein:

said added step is continued until leak-off through said apertures substantially becomes negligibly small.

9. The method set forth in claim 8 wherein:

after said leak-off substantially becomes negligibly small, said steps of providing perforating means, filling at least a portion of said wellbore, raising the pressure of said fracturing fluid and actuating said perforating means are repeated for stimulating a second subterranean formation located about said wellbore displaced from said first recited formation.

* * * * *